United States Patent [19]

Olszewski et al.

[11] 3,985,948

[45] Oct. 12, 1976

[54] WATERTIGHT DISC COAXIAL CABLES

[75] Inventors: Jerzy A. Olszewski, Edison; Ludwik Jachimowicz, Elizabeth, both of N.J.

[73] Assignee: General Cable Corporation, Greenwich, Conn.

[22] Filed: Mar. 12, 1975

[21] Appl. No.: 557,646

Related U.S. Application Data

[63] Continuation-in-part of Ser. No. 419,495, Nov. 28, 1973, abandoned.

[52] U.S. Cl. ..... 174/28; 156/47; 174/126 R

[51] Int. Cl.[2] ..... H01B 11/18; H01B 13/22

[58] Field of Search ..... 29/203 R, 203 C; 156/47, 51, 52, 53, 54, 55; 174/28, 29, 119 C, 126 R, 126 CP, 110 PM, 111

[56] References Cited

UNITED STATES PATENTS 3,660,589 5/1972 Jachimowicz et al. ..... 174/28

FOREIGN PATENTS OR APPLICATIONS 658,551 3/1938 Germany ..... 174/28

972,213 5/1959 Germany ..... 174/28

626,164 7/1949 United Kingdom ..... 174/119 C

*Primary Examiner*—Arthur T. Grimley

*Attorney, Agent, or Firm*—Sandoe, Hopgood & Calimafde

[57] ABSTRACT

This invention is a coaxial cable with watertight compartments between the discs that hold a center conductor coaxial with a tubular outer conductor. The object of the invention is to obtain greater mechanical strength for the cable without undue increase in attenuation. Discs are connected with the center conductor by a chromate conversion coating on the copper of the center conductor; by a polyethylene tube hugging the center conductor; and by necked down regions of the center conductor. This latter construction makes the cable suitable for microwave transmission as well as TV signals. Disc bonding to the outer conductor utilizes coatings on the inside surface of the outer conductor.

14 Claims, 8 Drawing Figures

WATERTIGHT DISC COAXIAL CABLES

RELATED PATENT APPLICATION

This application is a continuation-in-part of our application Ser. No. 419,495, filed Nov. 28, 1973, and now abandoned.

BACKGROUND AND SUMMARY OF THE INVENTION

To make a spaced disc coaxial cable suitable for outside use, the compartments within the cable must be watertight. If the outer conductor is punctured at any place, water which enters the punctured compartment must not be able to travel lengthwise along the cable beyond the damaged compartment.

One of the problems in constructing such a coaxial cable is that the mechanical strength and the watertightness is achieved partially at the expense of attenuation. For example, adhesive plastics which produce extremely strong bonds to metal have comparatively high dissipation factor and consequently the dielectric losses are fairly high. These dielectric losses are kept within tolerable limits by having air as the dielectric in between the plastic discs which hold the center conductor coaxial with the tubular outer conductor.

Polyethylene is a plastic which is commonly used for the spacer discs of coaxial cable. "Adhesive polyethylene" is a copolymer of ethylene and monomer containing acrylic acid and is made by the Dow Chemical Company under the trade designations of QX-2375 or SD-449. Another adhesive polyethylene is an ionomer manufactured by DuPont under the trade name of Surlyn. These adhesive materials can form a permanent bond with metals, especially aluminum, when heat and pressure are applied to the interface between the discs and the metallic components of the cable.

Other polyolefins, such as polypropylene can be used, but polyethylene is used in the preferred embodiment. The expression "adhesive polyolefin" as used herein, designates polyolefin which has been treated or combined with other material to give it polar characteristics and much stronger adhesion to metals.

The dissipation factor of adhesive polyolefins is higher than that of ordinary polyolefins which have not been treated to make them more adhesive to metals. Where the term "ordinary polyolefin" is used herein, it designates a polyolefin which has not been treated to increase its adherence to metals; and where the term "polyolefin" is used herein without further designation, the material referred to may be either adhesive or non-adhesive polyolefin.

The advantage of low dissipation factor is especially apparent on larger cables and at high frequencies. This is because in large cables attenuation contribution by conductors is comparatively low and the attenuation caused by dielectric losses is independent of cable size. Also the conductor losses at the higher frequencies increase as the square root of the frequency, while the dielectric losses are directly proportional to the frequency.

This invention obtains greater mechanical strength and greater watertightness between compartments of a coaxial cable without increase in attenuation or with such increase as occurs kept within tolerable limits. Several constructions are illustrated in the drawing and explained in the description of the preferred embodiments of the invention.

By necking down the cross-section of a center conductor at the region of the connection of the spacer discs to the conductor, the impedance at the discs can be made the same as at the air gaps so that the cable can be used to transmit microwave signals as well as TV signals.

Other objects, features and advantages of the invention will appear or be pointed out as the description proceeds.

BRIEF DESCRIPTION OF DRAWINGS

In the drawing, forming a part hereof, in which like reference characters indicate corresponding parts in all the views.

DESCRIPTION OF PREFERRED EMBODIMENT

Figure 1:
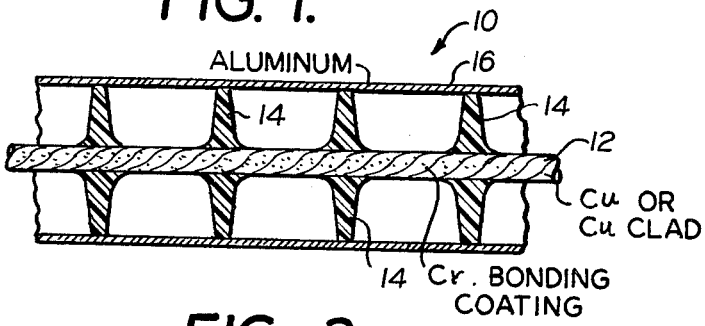
FIG. 1 is a fragmentary sectional view of a coaxial cable with the center conductor more securely bonded to the spacer discs as the result of coating on the inner conductor formed by a chemical reaction with the surface of the inner conductor.
Figure 2:
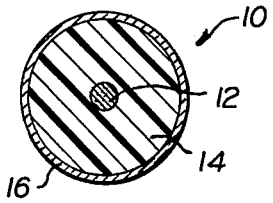
FIG. 2 is a sectional view taken on the line 2—2 of FIG. 1.

FIG. 1 shows a coaxial cable 10 having a center conductor 12 with spacer discs 14 connected to the center conductor 12 at evenly spaced locations along the length of the cable. The cable has an outer tubular conductor 16 secured to the circumferences of the discs 14.

To obtain an extremely strong bond between the dielectric discs 14 and the center conductor 12, the conductor 12, made of copper or clad with copper, is immersed in a chromate bath which is an acidic solution containing hexavalent chromium compounds, plus other inorganic or organic compounds known as activators or catalysts and such as are used with chemical dips. The chemical attack that occurs results in a film formation which comes from a partial reduction of the hexavalent chromium in the bath by the copper. This is not a metal plating process, but the formation of a conversion coating on the center conductor; and the conversion coating is a chromium salt.

This conversion coating results in an extremely tenacious bond of polyethylene discs 14 to the center conductor when subjected to heat and pressure, especially if the discs 14 are made of adhesive polyethylene. The durability of the bond between adhesive discs 14 and the center conductor 12 has been found to be as much as a hundred to one as compared with known bondings of the prior art.

In actual cable making, the copper or copper clad center conductor 12 requires pre-treatment for degreasing and cleaning in general to enable free reaction between the metal surface and the chromate bath. Similiarly, after the chromate dip, a thorough rinse is necessary to remove any residual acid that did not react with the copper. Finally, the conductor 12 is dried before it enters a disc molding station as will be illustrated in FIG. 7A.

The preferred steps in preparing for the chromate conversion coating are:

1. Degrease if necessary.
2. Chromate bath dip.
3. Water rinse.
4. Dry.

A chromate solution that has given excellent results is "Duracoat Conver-Cop" manufactured by Heat-Bath Corporation of Springfield, Mass.

In manufacturing operations that involve drawing of the wire, the chromate treatment must be done after the wire drawing because drawing destroys the layer provided by the chromate treatment.

A very greasy, oily wire should be degreased. In the case of drawn wire, the very thin oil film left on the wire does not act as an inhibitor to the reaction between the copper surface and the acidic bath. The only effect of this thin oil layer is a slight increase in the acid consumption. The chromate conversion coating on the copper is produced by simple chemical dip.

The treatment results in the formation of a thin film which is colorless, clear metal salt and which is metallic bright to iridescent yellow depending on the time of treatment and the concentration of the solution.

Following the formation of the chromate conversion coating, thorough rinse is necessary to remove any traces of the acid that has not reacted with the copper. Hot or cold rinse or a combination of both is satisfactory.

For the chromate bath, the plant run was performed at 33 percent acid concentration, 120° F bath temperature and 60 seconds immersion time. Other experience has indicated that at the same concentration and temperature, 30 seconds immersion gives adequate protection. To improve the protection with 30 seconds immersion time, it is possible to increase the bath concentration to 66 percent. Although increasing the temperature would normally increase the rate of chemical reaction between the copper and the chromic acid, experience has shown that the increase in the bath temperature is objectionable because it causes the acid remaining on the wire surface to dry up before reaching the rinsing station.

The wire can be successfully washed by passing it through a running water rinse for a period of approximately 3 minutes. The use of water jets can accomplish the same rinsing action in a significantly shorter time.

Figure 3:
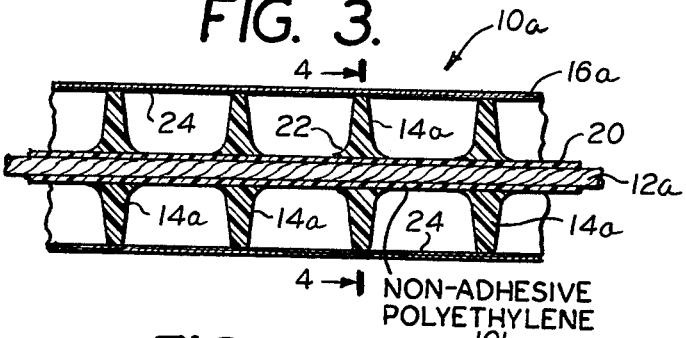
FIG. 3 is a view similar to FIG. 2 but showing a different modification of the invention.

Another construction for increasing the adherence of discs to a center conductor is shown in FIG. 3. A cable 10*a* has a center conductor 12*a* and a tubular outer conductor 16*a*. Spacer discs 14*a* hold the center conductor 12*a* coaxial with the outer tubular conductor 10*a*.

Figure 4:
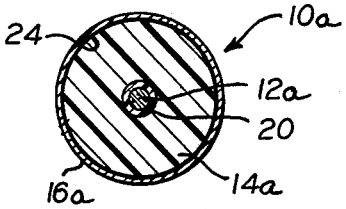
FIG. 4 is a sectional view taken on the line 4—4 of FIG. 3.

In the construction shown in FIGS. 3 and 4, however, the spacer discs 14*a* do not contact directly with the center conductor 12*a*. A thin wall tube 20 surrounds the center conductor 12*a* and hugs the conductor 12*a*. This tube 20 is preferably made of regular polyethylene having a thickness up to 5 mils. It is preferably bonded to the center conductor 12*a* by fusion bonding.

The spacer discs 14*a* are molded around the tube 20. These discs 14*a* are preferably adhesive polyethylene and they are bonded to the tube 20 by heat and pressure.

The spacer discs 14*a* cannot move axially because of their connection to the tube 20 and the connection of the tube 20 to the center conductor 12*a*. The possibility of axial movement of the discs 14*a* is further prevented by the fact that the tube 20 is continuous along the length of the inner conductor 12*a* and thus the portions of the tube 20 between the discs provides an additional mechanical connection for preventing independent movement of any of the discs 14*a* with respect to any other disc on the inner or outer conductor.

Each disc 22 has a hub portion where it approaches most closely to the center conductor 12*a* and the hub portion 22 is substantially wider than elsewhere on 14*a*, in an axial direction, so that the opening through the disc for the tube 20 has substantially larger area of contact with the tube 20 than would be the case if the hub portions were not of greater axial length. The portions of the tube 20 within the hub portions 22 of the discs and those parts of the tube 20 which are beyond but adjacent to the discs greatly increase the effective area of bonding of the discs to the center conductor 12*a* by means of the intervening tube 20.

The material that forms the tube 20 can be applied to the center conductor 12*a* by extrusion plating in a separate operation, tandemized or not, or it can be molded using a separate ram and cavity at the same time and prior to molding the adhesive discs 14*a* around the tube 20. After the outer conductor 16*a* has been applied to the discs 14*a* as will be explained in connection with FIGS. 7A and 7B. The outer tubular conductor 16*a* is heated to connect it with the circumferences of the spacer discs 14*a*.

FIG. 3 shows the tubular outer conductor 16*a* coated on its inside surface with an adhesive coating 24, which is preferably adhesive polyethylene. This coating is not essential when the spacer discs 14*a* are made of adhesive polyethylene. In such a case the adhesive polyethylene spacer discs 14*a* can be bonded directly to the tubular outer conductor 16*a* and obtain a very strong bond with the tubular outer conductor.

By applying a coating 24 of adhesive polyethylene to the inside surface of the tubular outer conductor 16*a*, however, adequate mechanical strength and watertightness can be obtained with spacer discs 14*a* which are made of non-adhesive polyethylene. This has the advantage of reducing the attenuation of the cable because of the lower dissipation factor of the spacer discs 14*a* when made of regular polyethylene.

The introduction of the solid polyethylene tube 20 over the center conductor 12*a* increases the effective dielectric constant of the cable insulation when compared to a cable with no such tube 20. Therefore, for fixed disc dimensions and the dimensions of the tubular aluminum outer conductor 16*a*, the diameter of the center conductor 12*a* has to be reduced in order that nominal cable independence is met. This increases slightly the attenuation because of increase in conductor losses but the conductor losses are partially offset by the decrease in dielectric losses. The total change in attenuation is, therefore, the algebraic sum of the change in attenuation caused by the increase in conductor losses and that caused by the decrease in dielectric losses and it is somewhat less than an increase of approximately 2 percent.

When using a coating 24 on the inside surface of the tubular outer conductor 16*a*, the coating 24 can be applied in a separate operation. In order to get watertightness, thin adhesive copolymer or ionomer film can be parallel folded over the cable core, or stuck to the inside of oversize aluminum outer conductor 16*a* before the outer conductor is swedged down over the discs as will be described in FIGS. 7A and 7B. The adhesive polyethylene of the coating 24 is preferably limited to about 2 mils in thickness and it bonds well to both the metal of the tubular outer conductor 16*a* and to the circumferences of the spacer discs 14*a*. The heat for achieving the bonding can be a flash heating of the outer metal conductor 16*a* after the outer conductor has been brought down tightly over the discs.

This use of regular polyethylene for both the tube 20 and the discs 14*a* has the advantage of substantially reducing high frequency attenuation of the cable; and it makes possible the molding of the tube 20 and the discs 14*a* in the same mold and at the same time. The actual decrease depends on cable size, amounts of dielectric, as well as their actual dissipation factors and dielectric constants. A 0.75 inch CATV cable can be expected to have about 18 percent lower attenuation at 300 MHz than a 0.75 inch CATV cable employing only adhesive discs instead of the non-adhesive discs combined with the adhesive layer 24.

Another variation is the use of an adhesive polyethylene tube 20 with spacer discs 14*a* of non-adhesive polyethylene, with or without the adhesive coating 24. This will obtain only about 14 percent attenuation improvement in 0.75 inch CATV cable at 300 MHz as compared with a construction having adhesive polyethylene discs only.

Figure 5:
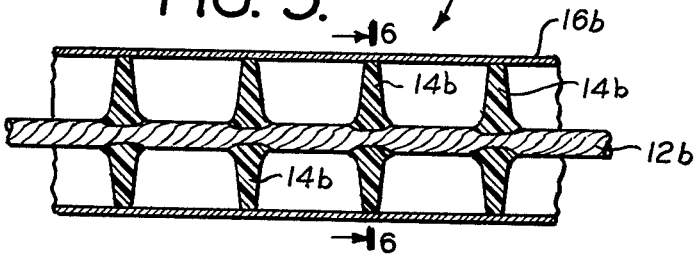
FIG. 5 is a sectional view similar to FIGS. 1 and 2 but showing still another modification of the invention.
Figure 6:
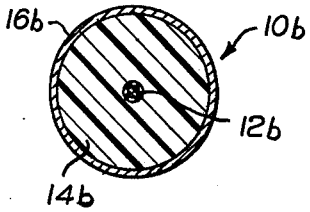
FIG. 6 is a sectional view taken on the line 6—6 of FIG. 5.

The lowest possible attenuation can be obtained with use of a good grade of non-adhesive polyethylene polymer only, and in such a case a watertightness is a function of pressure molding over the center conductor and radial compression of the outer peripheries of the spacer discs by the tubular outer conductor. The mechanical structure and strength of such a cable can be improved by using a center conductor 12*b* as shown in FIGS. 5 and 6.

Spacer discs 14*b* are located at evenly spaced regions along the center conductor 12*b*, and the outer conductor 16*b* is swedged down around the spacer discs 12*b* in a manner to radially compress the discs 12*b*. In the construction shown in the FIG. 5, the portions of the center conductor 12*b*, which are located within the spacer discs 14*b*, are necked down to cross-sections smaller than that of the center conductor 12*b* where it extends between the spaced discs 14*b*.

This construction can be obtained at the disc molding station. The inner conductor is under tension in the disc molding station. The molding of the discs on the center conductor increases the temperature of the center conductor within the discs, so that the hotter parts of the center conductor stretch as it is pulled from the molding station. The stretch and necking down of the cross section of the inner conductor is greatest where the temperature is highest, and that is at the middle of the discs.

This is an interesting construction because the necked down portions of the center conductor 12*b* not only prevent the spacer disc 14 from moving axially, but the reduced cross-sections at the conductor can be correlated with the construction of the discs so as to make the impedance of the cable at the discs the same as along the air gaps between the discs.

The characteristic impedance Z at any location along the coaxial cable shown in FIG. 5 is expressed by the equation:

$$Z = \frac{K \log D/d}{E}$$

Where $Z$ equals characteristic impedance
$K$ = constant for the construction
$D$ = inside diameter of the outer conductor 16*b*
$d$ = the outside diameter of the inner conductor 12*b*
$E$ = dielectric constant of the space separating the inner conductor from the outer conductor.

At locations where the space between the conductors is entirely air, $E$ equals 1. At locations where the space is entirely filled with the polyethylene disc, $E$ equals 2.3. At locations where the radial taper of the discs would result in a plane, which intersected the coaxial cable normal to the axis of the cable, that would pass partly through air and partly through the hub portion of the disc, the value of the dielectric constant is greater than 1 and less than 2.3, the exact value depending upon the proportion of the radius that is polyethylene and the proportion that is air.

From an inspection of the equation for characteristic impedance, it is evident that if the dielectric constant increases, the impedance can be held constant by decreasing the value $d$ so that the factor log $D/d$ changes in value to the same extent that the denominator factor square root of $E$ increases.

In the construction shown in FIG. 5, the discs 14*b* are made with greater axial thickness toward the center of the discs. This is a desirable construction because it increases the strength of the discs as they approach the inner conductor and thereby provides the discs with greater strength where they need it in order to resist the forces encountered when the cable is bent and the discs are subject to stresses which would tilt them with respect to the inner conductor. The characteristic impedance in FIG. 5 can be made constant along the length of the coaxial cable by having the reduced diameter of the inner conductor 12*b* constant where the discs have their full diameter; and by having the diameter of the necked down portion of the inner conductor 12*b* increase at a rate to offset the decreased radial thickness of the disc as it approaches the inner conductor.

By having this constant characteristic impedance, the coaxial cable can be used as a wave guide because it avoids the setting up of reflection waves such as occur where there is a change in the characteristic impedance of a wave guide.

In this way the cable can be made to transmit microwave signals since relections from individual discs can be minimized or eliminated. An additional utility of the cable is thus provided in addition to the use for transmitting TV signals.

Figure 7A:
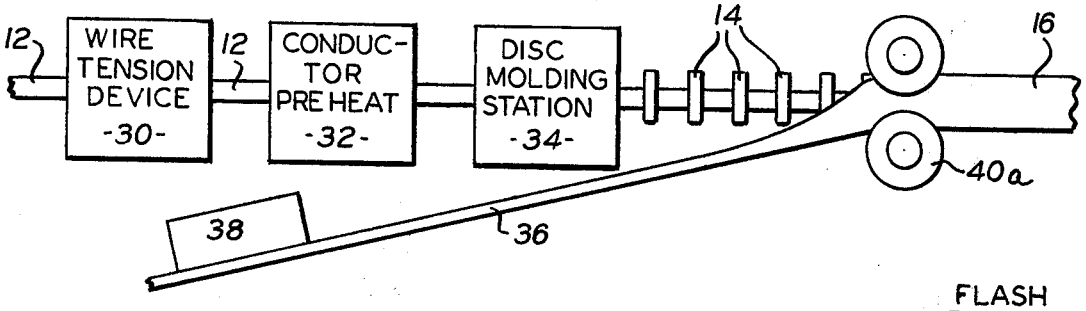
FIGS. 7A and 7B are diagrammatic views showing the method by which the constructions of the other figures are manufactured.
Figure 7B:
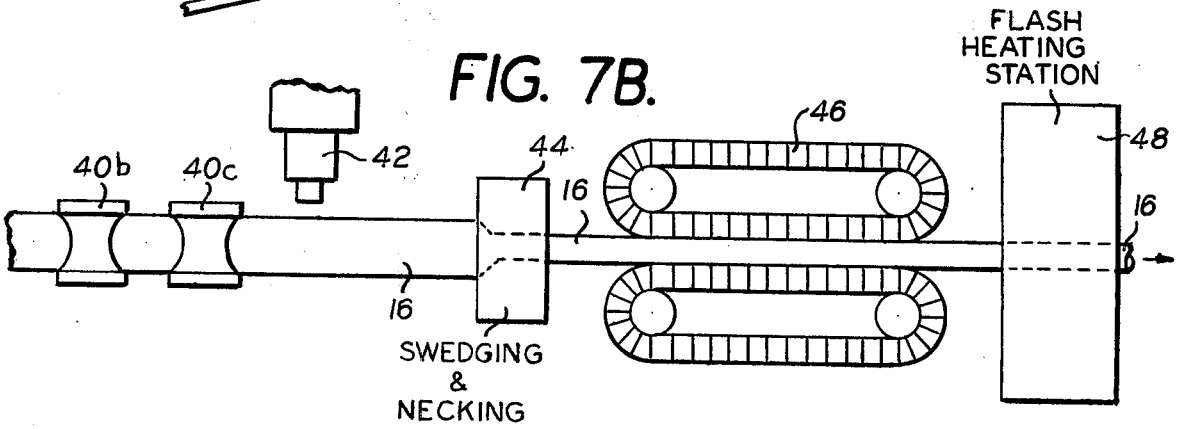

FIGS. 7A and 7B illustrate diagrammatically apparatus for making the cable of this invention and also illustrate the method of making it. The inner conductor 12 comes from a suitable supply source and it first passes through a wire tensioning device 30 and then to a conductor pre-heating station 32. After pre-heating, the conductor 12 passes through a disc molding applicator 34 in which the spacer discs 14 are molded around the center conductor 12.

A strip of aluminum 36 passes through a coating station 38 where the coating is applied to the side of the strip 36 which will be the inside surface of the tubular outer conductor when a coated outer conductor is necessary for the construction shown in FIG. 3. Roll-passes 40*a*, 40*b* and 40*c* represent the forming mill for longitudinally folding the aluminum strip 36 around the core of the coaxial cable to form the tubular outer conductor 16.

With the seam of the tubular outer conductor 16 at the top of the tube, a welding device 42 welds the seam closed; and the tubular outer conductor 16 than passes through a swedging die 44 where the diameter of the tubular conductor 16 is reduced to the extent necessary to bring it in contact with the circumferences of the spacer discs 14 and to impart a substantial radial compression to the discs 14.

A pulling capstan 46 pulls the tube 16 through the swedging die and maintains the desired tension in the outer conductor 16 as it increases in length as a result of the swedging operation. Beyond the pulling capstan 46, the outer conductor 16 is subjected to a flash heating at a flash heating station 48. This flash heating fuses the circumferences of the discs 14 to the outer conductor 16, whether coated or uncoated, and does so without melting sufficient of the plastic of the spacer discs to eliminate the substantial compression of these discs by the outer conductor.

Various combinations of the features illustrated in the different Figures of the drawing can be made. For example, the necked down portions of the inner conductor 12*b* of FIG. 5 can be used with the constructions shown in FIGS. 1 and 3.

The inner conductor can be made of copper; but it is more economical to make it of aluminum with copper cladding because the high frequency energy travels more in the surface portions of the conductor than in the interior and having the inner conductor of copper throughout its full cross-section does not reduce the resistance of the conductor sufficiently to justify the added expense.

Annular discs of uniform axial width can be used; but the preferred embodiment of the invention has hub portions of the discs which are of greater axial width than the circumferences of the discs. This adds greatly increased strength to the coaxial cable without introducing much additional plastic dielectric material into the space between the inner and outer conductors.

The discs are preferably substantially symmetrical about a plane extending substantially normal to the longitudinal axis of the inner conductor, which axis is the axis of the coaxial cable. In practice, the symmetry of the discs at their circumferences is slightly distorted by the increasing length of the outer conductor while it is being swedged into compressing contact with the discs. The advantage of having the discs substantially symmetrical about a plane normal to the axis of the cable is that greater pressure can be applied to the circumferences of the discs, and through the discs to the inner conductor, as compared to disc constructions of the prior art which were of frusto conical configuration.

FIGS. 7A and 7B are diametric showings of apparatus for making any of the cables shown in the other figures; but these FIGS. 7A and 7B are merely representative of such apparatus and do not include all of the steps that can be used. For example, the step of immersing the inner conductor in a chromate bath has not been illustrated since pre-treatments of wires in various processes is well known and not illustration of it seems necessary, other than FIG. 1, for a complete understanding of this invention and for purposes of searching.

Most of the apparatus is illustrated in FIGS. 7A and 7B by block diagrams since the actual construction used is not a part of the present invention and is also well understood in the art.

The flash heating step to bond the discs to the outer conductor is described fully in our co-pending patent application Ser. No. 321,641, filed Jan. 8, 1973, now U.S. Pat. No. 3,807,031.

The preferred embodiment of the invention has been illustrated and described, but changes and modifications can be made, and some features can be used in different combinations without departing from the invention as defined in the claims.

What is claimed is:

1. A watertight disc coaxial cable including in combination a center conductor having a copper circumferential surface, a plurality of axially-spaced dielectric discs firmly secured to the center conductor at spaced locations along the length of said conductor, and means for providing tenacious adherence of the discs to the copper, said means comprising a non-metallic conversion coating which is a copper-chromium salt between the copper surface of the center conductor and the surface of the disc that confronts the center conductor, and a tubular outer conductor surrounding the discs and exerting radial pressure on the discs, said discs being imperforate and adhered to the inner and outer conductors so as to divide the interior of the coaxial cable into watertight compartments.

2. The coaxial cable described in claim 1 characterized by said conversion coating being a salt of the copper surface of the inner conductor and an acidic solution containing hexavalent chromium compounds.

3. The coaxial cable described in claim 2 characterized by the discs being made of polyethylene and the conversion coating connecting the discs to the center conductor being a chromate conversion coating extending continuously along the length of the center conductor and being the reaction salt formed by the chemical attack on the copper circumferential surface of the center conductor by the acidic solution that causes a partial reduction of hexavalent chromium in the solution by the copper.

4. A watertight disc coaxial cable including in combination a center conductor having a circumferential surface, dielectric spacer discs firmly secured to the center conductor at spaced loactions along the length of said conductor and each having a substantially cylindrical circumferential surface and a tubular outer conductor surrounding the discs and exerting radial pressure on the circumferential surfaces of the discs, said discs being of progressively greater axial thickness as they extend from their circumferences toward the inner conductor and being imperforate between the inner and outer conductors and adhered to the inner and outer conductors so as to divide the interior of the coaxial cable into watertight compartments, the center conductor being of less diameter around its entire circumference, where it passes through each disc, than it is along the length of said inner conductor between the discs, the lesser diameter being progressively deeper as the inner conductor extends further into the portions of each disc that are of progressively greater axial thickness, and the outer conductor being of uniform diameter at the circumference of the discs and between said discs.

5. A coaxial cable including in combination a center conductor, a tubular outer conductor, discs of dielectric material on the center conductor and extending outward therefrom to maintain the center conductor spaced from the outer conductor and coaxial therewith, the discs being spaced form one another lengthwise of the cable and enclosing air chambers between them, the cross-section of the inner conductor having grooves that reduce the cross-section of the inner conductor at the discs to less than that of the inner conductor in the spaces between the successive discs, the grooves being of an axial length substantially equal to the axial width of the disc structure and of progressively less radial depth toward the ends thereof, the discs fitting snugly around and filling the grooves of the center conductor and held thereby against axial movement along the length of the center conductor, and the grooves extending circumferentially around the inner conductor so as to maintain the impedance uniform around the circumference of the center conductor.

6. The coaxial cable described in claim 5 characterized by the reduction in cross-section of the center conductor at the discs being correlated with the electrical characteristics of the discs to make the characteristic impedance of the cable at the discs substantially the same as at the air spaces whereby the cable can transmit microwave signals as well as high frequency television signals.

7. The coaxial cable described in claim 5 characterized by the dielectric discs being made of polyethylene and having hub portions of different axial thickness from the circumferential portions of the discs, and the cross-section of the center conductor at each groove being substantially reversely proportional to the diameter of the disc at each location along the axial length of the groove.

8. The coaxial cable described in claim 5 characterized by the center conductor being copper, the surfaces of the discs which surround the reduced diameter portion of the center conductor being shaped to fit the depressions caused by the reduced diameter at the grooves and being bonded to the circumference of the center conductor at the reduced diameter portions by a conversion coating of a chromium salt formed on the copper surface of the center conductor.

9. The coaxial cable described in claim 5 characterized by the discs being made of ordinary polyethylene bonded to the center conductor to hold them against axial movement along the conductor, and the discs fitting into the reduced diameter portions of the center conductor and contacting with the center conductor where the diameter of the center conductor is changing progressively in an axial direction whereby the slopes produced by the changing diameter augments the bonding in preventing axial movement of the discs along the center conductor.

10. A watertight disc coaxial cable including in combination a center conductor having a circumferential surface, a continuous coating of other material that surrounds and hugs the circumferential surface of the center conductor for improving the bonding of spacer discs to the center conductor structure, dielectric spacer discs firmly secured to the center conductor at spaced locations along the length of said conductor, and by the intervening coating of said other material, and a tubular outer conductor surrounding the discs and exerting radial pressure on the discs, said discs being imperforate and adhered to the inner and outer conductors so as to divide the interior of the coaxial cable into watertight compartments, and characterized by the continuous coating that hugs the center conductor being made of regular polyethylene and extending continuously lengthwise along the center conductor and through successive discs of the cable, and the discs being made of adhesive polyethylene having a dissipation factor higher than that of the regular polyethylene.

11. The coaxial cable described in claim 10 characterized by the inner conductor having a copper circumferential surface and with a coating of polyethylene of about 5 mils thickness on the entire surface of the inner conductor, the discs surrounding the polyethylene tube having hub portions of greater axial width than the portions of the discs that are radially further out from the center conductor, and the axial width of the hub portions being more than two and one half times the axial width of the discs at the circumferential portion of each disc.

12. The method of making a coaxial cable having a center conductor held coaxial with an outer tubular conductor by dielectric discs carried at spaced locations along the length of the inner conductor, characterized by pre-treating the inner conductor in a chromate bath to reduce a copper surface of the inner conductor and apply a conversion coating of a chromate salt layer on the surface of the inner conductor to more securely bond polyolefin discs to the inner conductor, applying non-adhesive dielectric spacer discs to the inner conductor at spaced locations therealong, forming the outer tubular conductor as an oversize outer tube around the outside of the discs, swedging the tube to a smaller diameter that causes the outside tube to grip tightly the circumferences of the discs and to put them under substantial radial compression.

13. The method of making a coaxial cable having a center conductor held coaxial with an outer tubular conductor by dielectric discs carried at spaced locations along the length of the inner conductor, applying a coating to the inner conductor to provide stronger adhesion of spaced discs to the inner conductor, applying non-adhesive dielectric spacer discs to the inner conductor at spaced locations therealong, forming an oversize outer tube around the outside of the discs, swedging the tube to a smaller diameter that causes the outside tube to grip tightly the circumferences of the discs and to put them under substantial radial compression, characterized by stretching the inner conductor to reduce the diameter of the inner conductor where it passes through the successive discs and while the discs are in subtantially molten condition and maintaining the inner conductor at high temperature where it passes through the discs to localize the stretching of the inner conductor to the regions in the discs, forming the respective discs with inner diameters that fit snugly around the reduced diameter portions of the inner conductor to hold the discs against axial movement along the inner conductor by the fuller diameter portions of the inner conductor between the discs.

14. The method of making a coaxial cable as described in claim 13 characterized by forming the discs with hub portions of greater axial width than the circumferences of the discs, and with the discs of radial cross-section substantially symmetrical about the longitudinal axis of the inner conductor, and pre-heating the inner conductor before applying the discs thereto.

* * * * *